US009593660B2

(12) United States Patent
Wright

(10) Patent No.: US 9,593,660 B2
(45) Date of Patent: Mar. 14, 2017

(54) METHOD AND APPARATUS OF CHARGING AN ENGINE IGNITION SYSTEM

(71) Applicant: Unison Industries, LLC, Jacksonville, FL (US)

(72) Inventor: Scott Brian Wright, Ponte Vedra Beach, FL (US)

(73) Assignee: Unison Industries, LLC, Jacksonville, FL (US)

( * ) Notice: Subject to any disclaimer, the term of this patent is extended or adjusted under 35 U.S.C. 154(b) by 248 days.

(21) Appl. No.: 14/205,457

(22) Filed: Mar. 12, 2014

(65) Prior Publication Data

US 2015/0260146 A1 Sep. 17, 2015

(51) Int. Cl.

| | |
|---|---|
| ***F02P 3/02*** | (2006.01) |
| ***F02P 3/08*** | (2006.01) |
| ***F02P 3/09*** | (2006.01) |
| ***F02P 9/00*** | (2006.01) |
| *F02P 15/00* | (2006.01) |

(52) U.S. Cl.

CPC ..... *F02P 3/0838* (2013.01); *F02P 3/0876* (2013.01); *F02P 3/096* (2013.01); *F02P 9/002* (2013.01); *F02P 3/0846* (2013.01); *F02P 15/001* (2013.01)

(58) Field of Classification Search

CPC F02P 3/0876; F02P 9/002; F02P 3/096; F02P 3/09

USPC ..... 123/406.66, 623; 315/209 T, 209 CD; 361/257

See application file for complete search history.

(56) References Cited

U.S. PATENT DOCUMENTS

| | | | | |
|---|---|---|---|---|
| 4,125,097 | A * | 11/1978 | Gunderson | F02P 5/1556 123/406.66 |
| 4,983,886 | A * | 1/1991 | Balland | F02P 3/0884 315/209 CD |
| 5,446,348 | A * | 8/1995 | Michalek | F02P 17/12 315/209 CD |
| 8,266,885 | B2 | 9/2012 | Wright | |
| 8,359,869 | B2 | 1/2013 | Wright | |
| 2003/0067284 | A1 | 4/2003 | Costello | |
| 2013/0206123 | A1 * | 8/2013 | Dirumdam | F02P 1/08 123/634 |

OTHER PUBLICATIONS

International Search Report and Written Opinion issued in connection with corresponding PCT Application No. PCT/US2015/017021 dated Jun. 9, 2015.

"Aviation High School", The Fuel & Ignition Systems of a Gas Turbine Engine. Information Sheet, Revision H., pp. 1-11, Dec. 2007.

* cited by examiner

*Primary Examiner* — Mahmoud Gimie
*Assistant Examiner* — David Hammaoui
(74) *Attorney, Agent, or Firm* — GE Global Patent Operation; William S. Munnerlyn

(57) ABSTRACT

A method for controlling the operation of an ignition exciter with a rechargeable energy source supplying electricity to a solid-state switch is disclosed. The method includes charging the energy source at a first rate when the voltage of the energy source is less than a first voltage reference value.

10 Claims, 4 Drawing Sheets

METHOD AND APPARATUS OF CHARGING AN ENGINE IGNITION SYSTEM

BACKGROUND OF THE INVENTION

Gas turbine engines for aircraft typically include an ignition system to aid in the starting of the engine. The engine ignition system may include an ignition exciter that stores energy and releases a high-energy spark to produce combustion of fuel in the engine in a way that is analogous to automobile ignition coils. The ignition exciter may provide sparks during initial engine start on the ground or, depending upon the environmental conditions, while the aircraft is airborne to prevent combustion from failing.

BRIEF DESCRIPTION OF THE INVENTION

In one aspect, an embodiment of the invention relates to a method for controlling the operation of an ignition exciter comprising a rechargeable energy source supplying electricity to a solid-state switch. The method includes charging the energy source at a first rate when the voltage of the energy source is less than a first voltage reference value, charging the energy source at a second rate, greater than the first rate, when the voltage of energy source is greater than a first voltage reference value, and discharging the energy source through the switch to generate a spark when the voltage of the energy source satisfies a discharge voltage reference value.

DETAILED DESCRIPTION OF THE INVENTION

Figure 1:
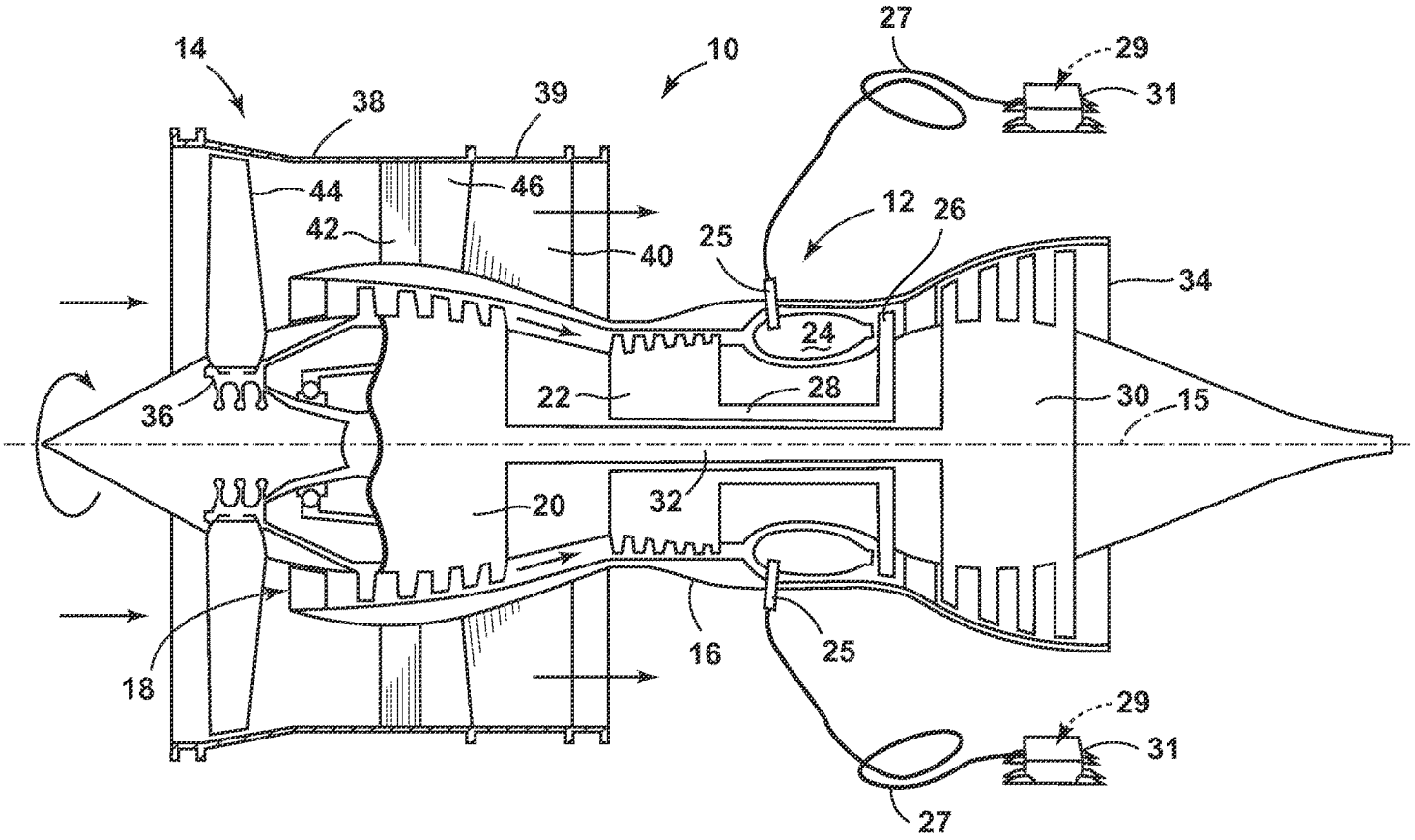
FIG. 1 is a schematic view of an exemplary gas turbine engine that includes a core engine section positioned axially downstream from a fan section along a longitudinal axis and an engine ignition system according to an embodiment of the present invention.

FIG. 1 is a schematic view of an exemplary gas turbine engine 10 that includes a core engine section 12 positioned axially downstream from a fan section 14 along a longitudinal axis 15. The core engine section 12 includes a generally tubular outer casing 16 that defines an annular core engine inlet 18 and that encloses and supports a pressure booster 20 for use in raising the pressure of the air that enters the core engine section 12 to a first pressure level. A high-pressure, multi-stage, axial-flow compressor 22 receives pressurized air from the booster 20 and further increases the pressure of the air. The pressurized air flows to a combustor 24 where fuel is injected into the pressurized air stream to raise the temperature and energy level of the pressurized air. An igniter plug 25 coupled via a lead line 27 to an ignition exciter circuit 29 may facilitate the initiation of combustion of the fuel air mixture in the combustor 24.

The ignition exciter circuit 29 is additionally coupled to a DC power source via a power source connector 31. The high energy combustion products flow to a first turbine 26 for use in driving the compressor 22 through a first drive shaft 28, and then to a second turbine 30 for use in driving the booster 20 through a second drive shaft 32 that is coaxial with the first drive shaft 28. After driving each of turbines 26 and 30, the combustion products provide propulsive jet thrust by being channeled from the core engine section 12 through an exhaust nozzle 34.

Surrounded by an annular fan casing 38, the fan section 14 includes a rotatable, axial-flow fan rotor 36. The fan casing 38 is supported about the core engine section 12 by a plurality of substantially radially-extending, circumferentially-spaced support struts 40. The fan casing 38 is supported by radially extending outlet guide vanes 42 and encloses the fan rotor 36 and a plurality of fan rotor blades 44. A downstream section 39 of the fan casing 38 extends over an outer portion of the core engine 12 to define a secondary, or bypass, airflow conduit 46 that provides additional propulsive jet thrust.

Figure 2:
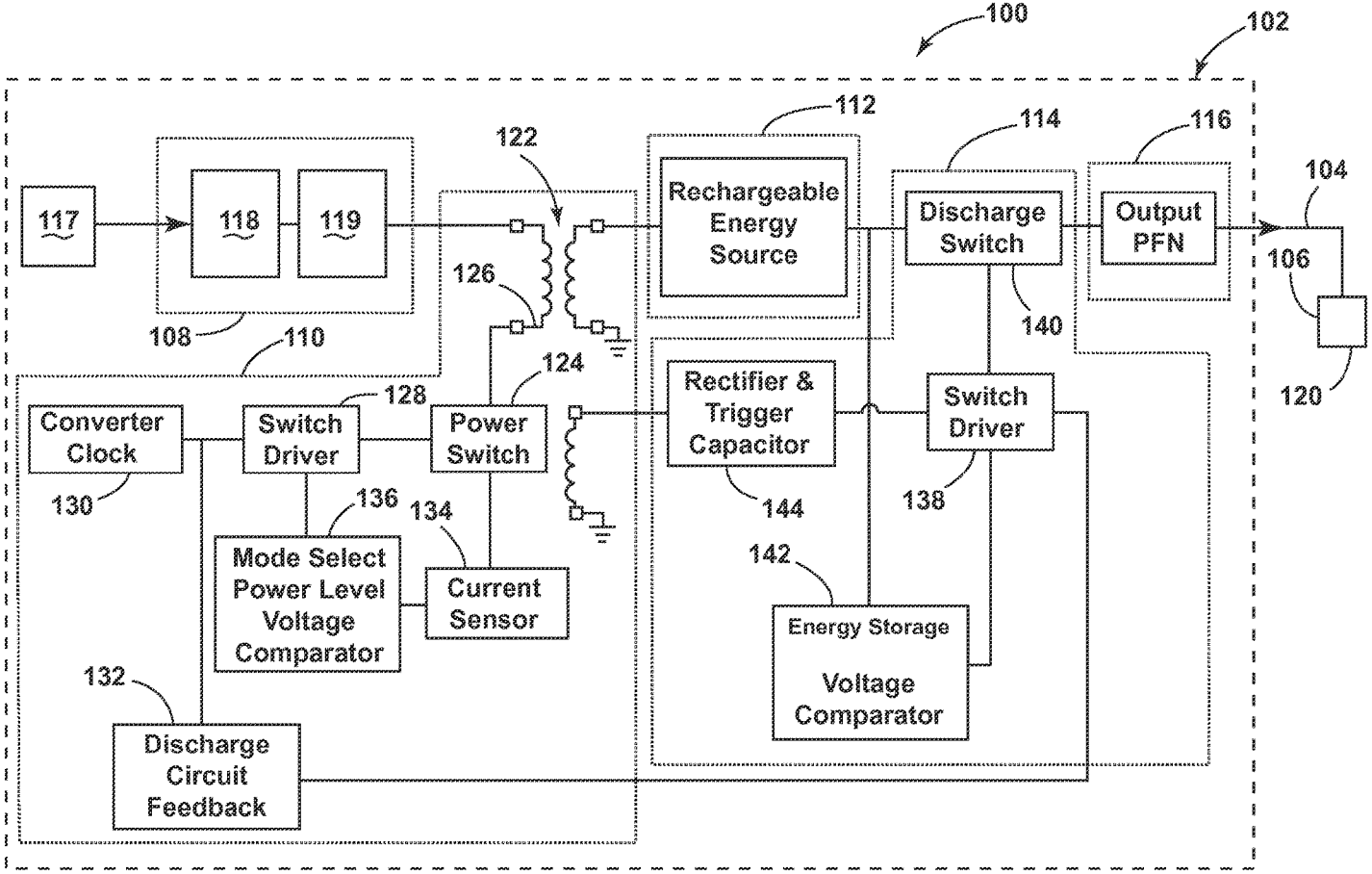
FIG. 2 is a schematic block diagram of an engine ignition system with a dual mode ignition exciter charging according to an embodiment of the present invention.

FIG. 2 is a schematic block diagram of an engine ignition system 100 with dual mode ignition exciter charging in accordance with an embodiment of the invention. The engine ignition system 100 includes an ignition exciter circuit 102, an ignition lead 104, and an igniter plug 106. The ignition exciter circuit 102 comprises an electronic unit that includes an EMI filter module 108, a power converter 110, a rechargeable energy source 112, a voltage monitoring circuit and discharge switch module 114, and a pulse-forming network (PFN) 116. The EMI filter module 108 is configured to receive a supply of relatively low, direct current (DC) voltage, for example, 28 volts DC from a DC source 117. DC sources may include elements of an aircraft electrical power system including, but not limited to a battery, a DC bus line or an auxiliary power unit (APU). The source may deliver DC voltage ranging from 28 volts DC up to 270 volts DC. Alternatively, the source may provide alternating current (AC) such as 115 volts AC at a frequency of 400 Hertz (Hz).

The EMI filter module 108 includes an EMI filter 118 and a smoothing capacitor 119 configured to prevent high frequency noise generated by the ignition exciter circuit 102 from leaking through the DC power input and to protect the power converter 110 from transient voltage surges present on the DC source 117. The power converter 110 may comprise a flyback type converter and is configured to step up an input voltage received from the EMI filter module 108 to an optimal level for energy storage. The power converter 110 utilizes a charge pump technique to build up the voltage at the rechargeable energy source 112 over a number of charge cycles. When the charge cycles have built the voltage at the rechargeable energy source 112 to a predetermined level, the charge pumping is interrupted, and the rechargeable energy source 112 is controlled to discharge. Alternatively, the power converter 110 is a DC-DC converter other than a flyback type converter.

The rechargeable energy source 112 is configured to store energy between sparking events. A voltage monitoring circuit and discharge switch module 114 is configured to release the energy stored in the rechargeable energy source 112. The PFN 116 is configured to optimize the shape and timing of the stored energy waveform for creating the spark at a firing tip 120 of the igniter plug 106. The PFN 116 may be an inductor but may also include a transformer and/or a high frequency capacitor to facilitate a higher output voltage or a longer duration for the resulting spark.

The ignition lead 104 transmits an output of the ignition exciter circuit 102 to the igniter plug 106. The igniter plug 106 conducts the energy from the ignition lead 104 to the firing tip 120 residing within the engine combustor 24 (shown in FIG. 1). A geometry of the firing tip 120 is configured to provide a predetermined spark plume within the engine combustor 24 to ignite a fuel and air mixture, thus initiating combustion. The actual energy delivered at the igniter firing tip 120 is a percentage of the stored energy in the exciter (typically 25-35%). The energy contained within the spark plume, as well as the rate at which sparks are delivered to the combustor are ignition parameters. For example, typical parameters for the energy range from 4 to 20 joules (J) and the spark rate is generally around 1 to 3 hertz (Hz).

The power converter 110 includes a transformer 122 and a power switch 124 electrically coupled to a primary winding 126 of the transformer 122. The power converter 110 also includes a first switch driver 128 electrically coupled to the power switch 124. A converter clock 130 and a discharge feedback circuit 132 are electrically coupled to the switch driver 128. A current sensor 134 is electrically coupled to the power switch 124 and a mode select power level voltage comparator 136.

The voltage monitoring circuit and discharge switch module 114 includes a second switch driver 138 electrically coupled to a discharge switch 140, a voltage comparator 142, a rectifier and a trigger capacitor module 144. The second switch driver is coupled to the discharge feedback circuit 132 in the power converter 110.

Figure 3:
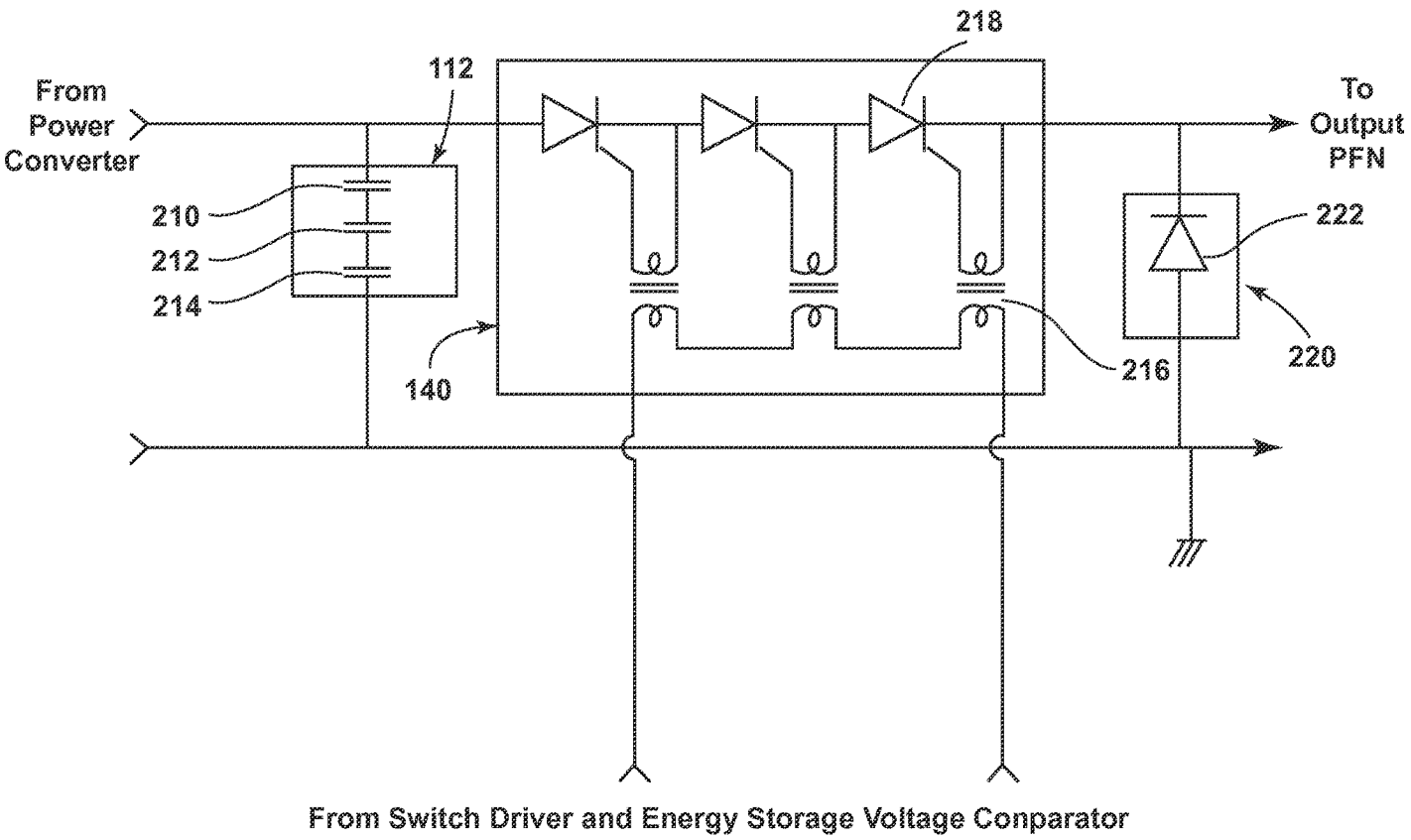
FIG. 3 is a circuit diagram illustrating the discharge switch and the rechargeable energy source of the ignition exciter.

FIG. 3 is a circuit diagram illustrating the discharge switch 140 and the rechargeable energy source 112 of the ignition exciter circuit 102. The rechargeable energy source 112 is electrically coupled across the output of the transformer 122 of the power converter 110. The discharge switch 140 is electrically coupled to one side of the rechargeable energy source 112. The other side of the discharge switch 140 is electrically coupled to a clamper circuit 220. The clamper circuit 220 is electrically coupled across the output PFN 116.

The rechargeable energy source 112 may include one or more energy storage or "tank" capacitors 210, 212, 214. The rechargeable energy source 112 may also include an array of storage capacitors 210, 212, 214 that may be coupled in parallel or in series. In this way, the voltage across the rechargeable energy source 112 includes the additive combination of the voltage across the array of in-series capacitors 210, 212, 214. Alternatively, the capacitors may be combined in parallel to implement a rechargeable energy source where the overall capacitance is the additive combination of the capacitance of the array of capacitors.

The clamper circuit 220 includes a freewheeling diode 222. Often coupled in parallel with a resistor (not shown), the freewheeling diode 222 eliminates sudden voltage spikes across an inductive load when a supply voltage from the rechargeable energy source 112 is suddenly reduced or removed, and provides an efficient energy delivery path once energy is switched from the rechargeable energy source 112, through the discharge switch 140 and into the circulating path formed by the PFN 116, the ignition lead 104 and igniter plug 106, and back through the freewheeling diode 222 as part of the timed energy release to facilitate optimal ignition.

The discharge switch 140 is a solid-state switch that may comprise one or more thyristors 218 connected in series, each having a high standoff voltage and pulse current capacity. Preferably, the solid-state switch 140 includes a single thyristor 218 but multiple solid-state switches may be implemented depending upon the required voltage of the ignition exciter circuit 102 and the rated voltage for the switches. Each thyristor 218 is inductively fired by way of a pulse transformer 216. Alternatively, the solid-state switch may include one or more insulated-gate bipolar transistor (IGBT) or metal oxide semiconductor field-effect transistor (MOSFET) devices.

The one or more thyristors 218 are inductively switched when the voltage in the storage capacitors 112 reaches a predetermined level for energy storage. When the voltage at the rechargeable energy source 112 reaches a predetermined voltage level (e.g., 2500 volts), the solid-state discharge switch 140 is closed so as to transfer the energy stored in the rechargeable energy source 112 to the output PFN.

Energy requirements of the engine ignition system 100 are specified to ensure sufficient energy delivery at the igniter firing tip 120 for a range of starting scenarios. Ignition exciters may endure temperature extremes ranging from −55° C. to 150° C. Exposure to high temperatures (e.g. above 121° C.) may limit the use of silicon semiconductor components (such as the one or more thyristors 218) for power switching and conversion because of excessive leakage current. That is, leakage current, or current that passes through a solid-state switch when it is ideally non-conductive (i.e. switched "off"), increases in solid-state switches as a function of temperature. In semiconductor devices like solid-state switches, leakage current is a quantum phenomenon where mobile charge carriers (electrons or holes) tunnel through an insulating region in the semiconductor. The phenomenon increases with temperature. While small levels of leakage current allow a solid-state switch to be considered as non-conductive, excessive leakage current running through the solid-state device renders the device deficient or inoperable as a switch. The leakage current must stay below a level that causes the solid-state device to overheat. The relationship between the leakage current and the junction temperature of the solid-state device is estimated by the following equation:

$$T_i = T_a + (V_d I_d \theta_{jc})$$

where $T_i$ is the junction temperature of the solid-state device, $T_a$ is the ambient temperature, the product of $V_d$ and $I_d$ is the power dissipation (i.e. the voltage and leakage current) and $\Theta_{jc}$ is the thermal resistance from the junction to the case of the solid-state device. Based on this relationship, for silicon semiconductors which typically have a thermal resistance of about 0.25 K/W, when the leakage current increases by about a factor of 10 between 100° C. and 121° C., the solid-state device experiences a significant increase in junction temperature. Therefore, for silicon semiconductors, the level of leakage current becomes excessive at about 121° C. and above.

Figure 4:
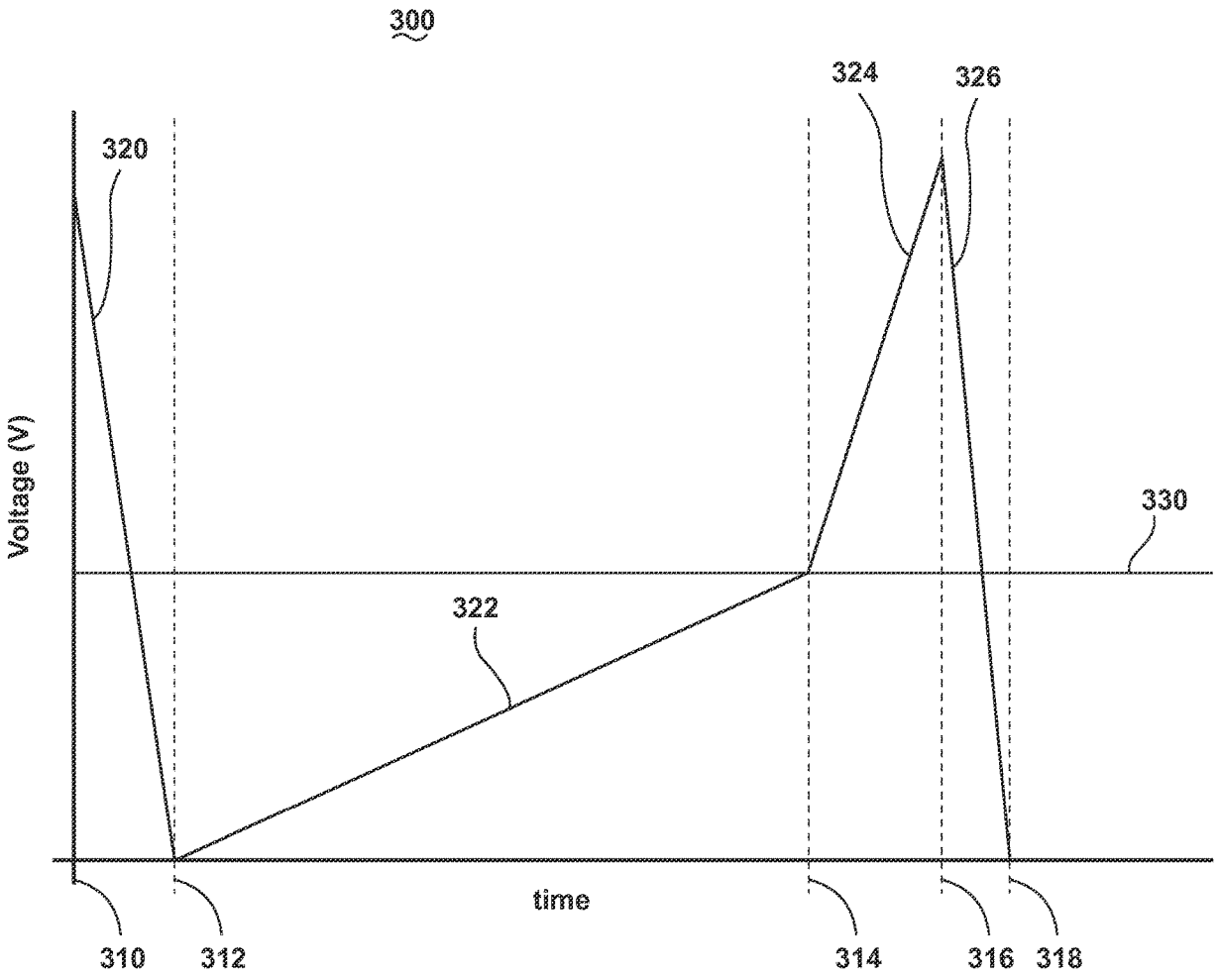
FIG. 4 is a graph demonstrating the dual mode charging of the ignition exciter according to an embodiment of the present invention.

FIG. 4 is a graph 300 demonstrating the dual mode charging of the ignition exciter circuit that limits the exposure of the solid-state switches to excessive temperatures (and subsequent leakage current). To control the operation of the ignition exciter circuit, particularly relating to repeated cycles of charging of the rechargeable energy source 112, the ignition exciter circuit performs at least two distinct charging modes. As shown, the graph 300 demonstrates a discharging of the rechargeable energy source 112 followed by a charging and discharging of the rechargeable energy source 112. As shown at an initial time 310, during operation of the ignition exciter circuit, the voltage in the rechargeable energy source 112 rapidly discharges 320 during a short duration of time from 310 to 312. The voltage level 322 in the rechargeable energy source 112 charges at a first rate for the duration of time ranging from 312 to 314.

Upon charging the rechargeable energy source 112 at a first rate, the voltage level 330 in the rechargeable energy source 112 satisfies a predetermined leakage threshold that is indicative of a leakage current through the solid-state switch that is excessive (i.e. the switch does not sufficiently turn off when in the non-conducting state). The predetermined threshold may include, but not be limited to one or more of a voltage level, a current level, a time duration, a temperature, a power level. A measurement of one or more of the threshold criteria may include a sensing of the relevant phenomenology on one or more of the above described ignition exciter elements, including but not limited to the rechargeable energy source 112, the transformer 122, the discharge switch 140, etc. The term "satisfies" the threshold is used herein to mean that the variation comparison satisfies the predetermined threshold, such as being equal to, less than, or greater than the threshold value. It will be understood that such a determination may easily be altered to be satisfied by a positive/negative comparison or a true/false comparison. For example, a less than threshold value can easily be satisfied by applying a greater than test when the data is numerically inverted. It is also contemplated that the received data may include multiple sensor outputs and that comparisons may be made between the multiple sensor outputs and corresponding multiple reference values.

Upon satisfying the predetermined threshold, the voltage level 324 in the rechargeable energy source 112 charges at a second rate for the duration of time ranging from 314 to 316. As shown in the figure, the first rate that the voltage level 322 in the rechargeable energy source 112 charges is less than the second rate that the voltage level 324 in the rechargeable energy source 112 charges. Finally, the voltage level 326 in the rechargeable energy source 112 rapidly discharges following the completion of the second rate of charging for the short duration of time ranging from 316 to 318. The dual mode charging operation then repeats at a predetermined spark rate.

As shown in FIG. 4, the ignition exciter circuit charges the rechargeable energy source 112 at a first rate when the voltage of the rechargeable energy source is less than a first voltage reference value. For example, each of the three capacitors 210, 212, 214 of the rechargeable energy source 112 may be simultaneously charged from 0 to 600 volts DC in a duration of approximately 800 milliseconds (ms). In this way, the first mode processes energy delivered by the power converter 122 over a timed sequenced that limits the voltage of the rechargeable energy source 112 below the level that allows excessive leakage current within the solid-state discharge switch 140. When the voltage of the rechargeable energy source 112 is greater than the first voltage reference value, the ignition exciter circuit charges the rechargeable energy source 112 at a second rate that is greater than the first rate. For example, each of the three capacitors 210, 212, 214 of the rechargeable energy source 112 may be simultaneously charged from 600 volts DC to 950 volts DC in 200 ms. The second charging mode increases the power processed from the power converter 122 at the end of the timed sequence to quickly complete the charging of the rechargeable energy source 112 before extensive heat is dissipated within the discharge switch 140 due to the higher voltage. The discharge switch 140 may be triggered and the rechargeable energy source 112 may be discharged through the solid-state discharge switch 140 to generate a spark when the voltage of the energy source satisfies a discharge voltage reference value. For example, the full 2,850 volts built up in the three capacitors 210, 212, 214 may discharge through the discharge switch 140 and be repeated at a rate of 1 to 3 Hz.

To charge the rechargeable energy source 112 according to the first charging mode described above, the power converter 110 may deliver power by sensing the voltage level of the rechargeable energy source 112 and setting the charging rate based on the sensed voltage level. For example, the energy storage voltage comparator 142 may directly monitor the voltage level of the rechargeable energy source 112 and initiate the mode select power level voltage comparator 136 to charge the rechargeable energy source 112 to a predetermined voltage level. Alternatively, instead of sensing the voltage level and establishing a predetermined voltage charge rate, the power converter 110 may deliver power over a timed sequence. That is, for a set voltage level and charge rate, the power converter 110 may deliver power for a set time duration. The mode select power level voltage comparator 136 may initiate a predetermined duration that is indicative of the voltage limit of the rechargeable energy source 112 that is below the level where excessive leakage current occurs within the discharge switch 140.

Subsequent to the first charging mode sequence, during the second mode, the power converter 110 delivers power to quickly complete the charging of the rechargeable energy source 112 before extensive heat is dissipated within the discharge switch 140. The increase in power conversion is necessary to maintain the spark rate during higher temperature operation. Consequently, the second charging period may be minimized in time by maximizing the second charging rate for optimal switching performance. That is, to maintain a spark rate (i.e. one spark per the duration of time ranging from 312 to 318) as per the requirements of a particular gas turbine engine, the duration of time ranging from 312 to 316 is the total available charge time. The maximum rate at which the voltage level of the rechargeable energy source 112 may be charged is limited by the physical and electrical characteristics of the ignition exciter circuit elements including the rechargeable energy source 112 and the transformer 122. By charging rechargeable energy source 112 to the voltage level 324 during the second charging rate for the time ranging from 314 to 316 at the maximum charging rate, the duration of time from 314 to 316 is minimized. By charging the rechargeable energy source 112 at the maximum charging rate once the rechargeable energy source is charged to the voltage level 330 where the leakage current through the solid-state switch is excessive until the time 316 where the spark is generated, the remaining duration of time ranging from 312 to 314 is the maximum duration of time to charge the rechargeable energy source 112 at the slowest charging rate. Therefore, the duration of time from 312 to 314 is maximized and consequently, the first charging rate for the time duration of time from 314 to 316 is minimized. Durations of time to buffer the voltage level may be added prior to the initiation of the first charging at time 312 or at any time during the first charging duration ranging from 312 to 314 to maintain a desired spark rate.

Increasing the reference voltage of the mode select power level voltage comparator 136 that monitors the current mode control enable the increased conversion of energy from the power converter 110 to the rechargeable energy source 112 for the second charging mode. The increase in reference voltage allows additional current (and power) to be generated during each flyback cycle (i.e. charging and discharging stages of the transformer 122) before the mode select power level voltage comparator 136 triggers the main power switch 124 off, thus transferring the power to the rechargeable energy source 112.

The technical effect is to maintain the spark rate during higher temperature operation where the leakage current of the solid-state switch increases with temperature. Consequently, solid-state switches may be used for ignition exciters designed for ignition systems with high spark energy requirements. As such, solid-state discharge switches may be used in ignition systems of large aircraft.

To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described. All combinations or permutations of features described herein are covered by this disclosure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method for controlling the operation of an ignition exciter comprising a rechargeable energy source supplying electricity to a solid-state switch, the method comprising:

charging the energy source at a first rate when the voltage of the energy source is less than a first voltage reference value;

charging the energy source at a second rate, greater than the first rate, when the voltage of energy source is greater than a first voltage reference value; and discharging the energy source through the switch to generate a spark when the voltage of the energy source satisfies a discharge voltage reference value, wherein the charging and the discharging the energy source are repeated, charging the energy source at the first rate occurs during a first period and charging the energy source at the second rate occurs during a second period between the repeated dischargings of the energy source, and the second period is minimized by charging the energy source at a maximum charging rate, and the first period is maximized relative to a total amount of time between the repeated dischargings of the energy source.

2. The method of claim 1 wherein the first voltage reference value is indicative of a corresponding temperature of the switch where a level of current leaking through the solid-state switch satisfies a leakage threshold.

3. The method of claim 1 wherein charging the energy source comprises charging a capacitor.

4. The method of claim 1 wherein charging the energy source comprises charging an array of at least one of in-parallel or in-series capacitors.

5. The method of claim 4 wherein charging the array of in-series capacitors comprises simultaneously charging the at least one of in-parallel or in-series capacitors.

6. The method of claim 1 wherein the charging and the discharging the energy source are repeated at a predetermined rate.

7. The method of claim 6 wherein the predetermined rate is indicative of a corresponding spark rate delivered to an igniter plug.

8. The method of claim 7 wherein the spark rate is 1 Hz.

9. The method of claim 1 wherein the first period is 800 milliseconds.

10. The method of claim 1 wherein the second period is 200 milliseconds.

* * * * *